US005535563A

United States Patent [19]

Brown et al.

[11] Patent Number: 5,535,563

[45] Date of Patent: Jul. 16, 1996

[54] FITTED MANUFACTURED STONE SECTIONS

[75] Inventors: Richard L. Brown, Napa, Calif.; Donald W. Ferguson, Coquitlam, Canada; Kenneth V. Brown, Jr.; Robert W. Heath, both of Napa, Calif.

[73] Assignee: Stone Products Corporation, Napa, Calif.

[21] Appl. No.: 2,305

[22] Filed: Jan. 8, 1993

[51] Int. Cl.[6] ..... E04B 2/88

[52] U.S. Cl. ..... 52/235; 52/314; 52/316; 52/596

[58] Field of Search ..... 52/314, 316, 389, 52/390, 596, 605, 235

[56] References Cited

U.S. PATENT DOCUMENTS

| | | | |
|---|---|---|---|
| 1,864,774 | 6/1932 | Storm | 52/390 |
| 2,245,047 | 6/1941 | O'Dell | 52/314 |
| 3,185,255 | 5/1965 | Bird | 52/596 |
| 3,545,154 | 12/1970 | Bobzin | 52/314 X |
| 4,266,382 | 5/1981 | Tellman | 52/314 X |
| 4,554,769 | 11/1985 | Fujii | 52/390 X |
| 4,931,331 | 6/1990 | Owens | 52/390 X |
| 4,971,649 | 11/1990 | Aydin | 52/390 X |
| 5,060,433 | 10/1991 | Buryan | 52/235 |
| 5,083,405 | 1/1992 | Miller | 52/235 |
| 5,138,809 | 8/1992 | Saikachi | 52/235 |

FOREIGN PATENT DOCUMENTS

| | | | |
|---|---|---|---|
| 1950946 | 4/1971 | Germany | 52/605 |
| 2008036 | 9/1971 | Germany | 52/605 |

*Primary Examiner*—Carl D. Friedman
*Assistant Examiner*—Beth A. Aubrey
*Attorney, Agent, or Firm*—Townsend and Townsend and Crew

[57] ABSTRACT

The invention provides a wall structure of precast concrete sections (2) having face surfaces (10) which resemble natural ledgestone, ashlar, rock face, or other stone textures surfaces and shapes. The sections are provided with grooves (14) at the upper (4) and lower (8) surfaces. The grooves accept overflow of mortar or adhesive which coats the surface to which the sections are to be bonded. Thus, the excess mortar is substantially hidden within the grooves where it acts as additional bonding between the layers of sections. At their lateral surfaces (6), the sections are angled to further resemble the appearance of natural stone upon installation. Methods of installation are also provided.

13 Claims, 4 Drawing Sheets

FITTED MANUFACTURED STONE SECTIONS

BACKGROUND OF THE INVENTION

The invention relates generally to a wall structure resembling natural stone. More specifically, the invention relates to a facade or veneer suitable for placement on structures such as buildings, fences or walls in which individual sections fit closely together resembling natural stone.

Many consumers and building owners prefer wall structures resembling natural stone such as ledgestone, field stone and quarried rock. The use of natural stone is limited by factors such as expense, availability, and difficulty of handling and transport due to heavy weight. Additionally, some geographic areas are subject to earthquake activity. This geological phenomenon can render traditional stone structures impractical or dangerous. The present invention provides a decorative or aesthetically pleasing facade which is lightweight and low cost as compared to a natural product.

SUMMARY OF THE INVENTION

The invention provides a block, section or component for use as a wall structure such as a facing layer or facade of a wall. The invention could be used wherever one wishes to display an appearance resembling natural stone. For example, the invention could be used not only to cover a wall but also to incorporate into a fireplace, a pillar, a ledge or some other construct which may be either structural or decorative. The section is typically substantially quadrilateral in outline, but it may take other shapes such as a triangular one.

The invention provides an interlocking modular system of precast fitted stone sections, blocks or components which fit together easily and quickly. The system reduces the labor, time and cost required for stone cutting, fitting, grouting and jointing when using natural stone. The final appearance of the installed invention resembles natural dry stacked stone such as ledgestone or cut or quarried stone having ashlar dimensions.

The sections duplicate crevices, lines, shadows, colorations and weathered edges found in naturally occurring stone or precut chiseled or rock faced surfaces or edges of hand treated natural stone. The sections are lightweight and are provided in a variety of shapes which are prefitted to help the user or consumer to quickly achieve a finished look of natural stone. The invention can be used in many applications. For instance, it can be used as an interior facing or an exterior veneer to a home or other building.

The back surface of the section is intended to contact an adhesive which holds the section to a structure such as a wall or a lathing. The adhesive may be any of a number of bonding means known in the art such as mortar, concrete, mastic, epoxy, adhesive and grout.

The top and bottom surfaces of the section have longitudinally oriented grooves. These grooves accept adhesive which overflows onto the upper or lower section surface when the section is compressed or embedded against the surface to which it is to be permanently bound. This feature permits the sections to be placed very closely together. Thus, the invention may avoid the obvious external appearance of a layer of grout or mortar between sections and enhance the natural stone appearance.

The grooves have the additional feature of forming a key with the overflowed mortar, mastic or adhesive. Thus, the key formed by one section fits together with a co-operating key formed by an overlying or underlying section. This additionally facilitates bonding of the section members.

In a preferred embodiment, the ledgestone pattern, the lateral surfaces of the section are not necessarily perpendicular to the upper and lower surfaces. Preferably, the lateral surface or a portion thereof forms an angle of approximately 30° with either an upper or a lower surface. When forming a joint between two cooperating angled lateral surfaces, the finished product resembles natural ledgestone more closely than a conventional manufactured brick product.

The grooves may be formed by any of a number of means such as, for example, drilling, cutting, casting or molding. Preferably, the sections are formed of concrete. The sections may be applied to any of a number of surfaces. For example, the sections could be applied to a lathing which is typically formed of metal, plywood or concrete. Additionally, the sections could be directly applied to a wall or any structurally sound substrate, such as drywall masonry.

DESCRIPTION OF THE PREFERRED EMBODIMENT

Figure 1:
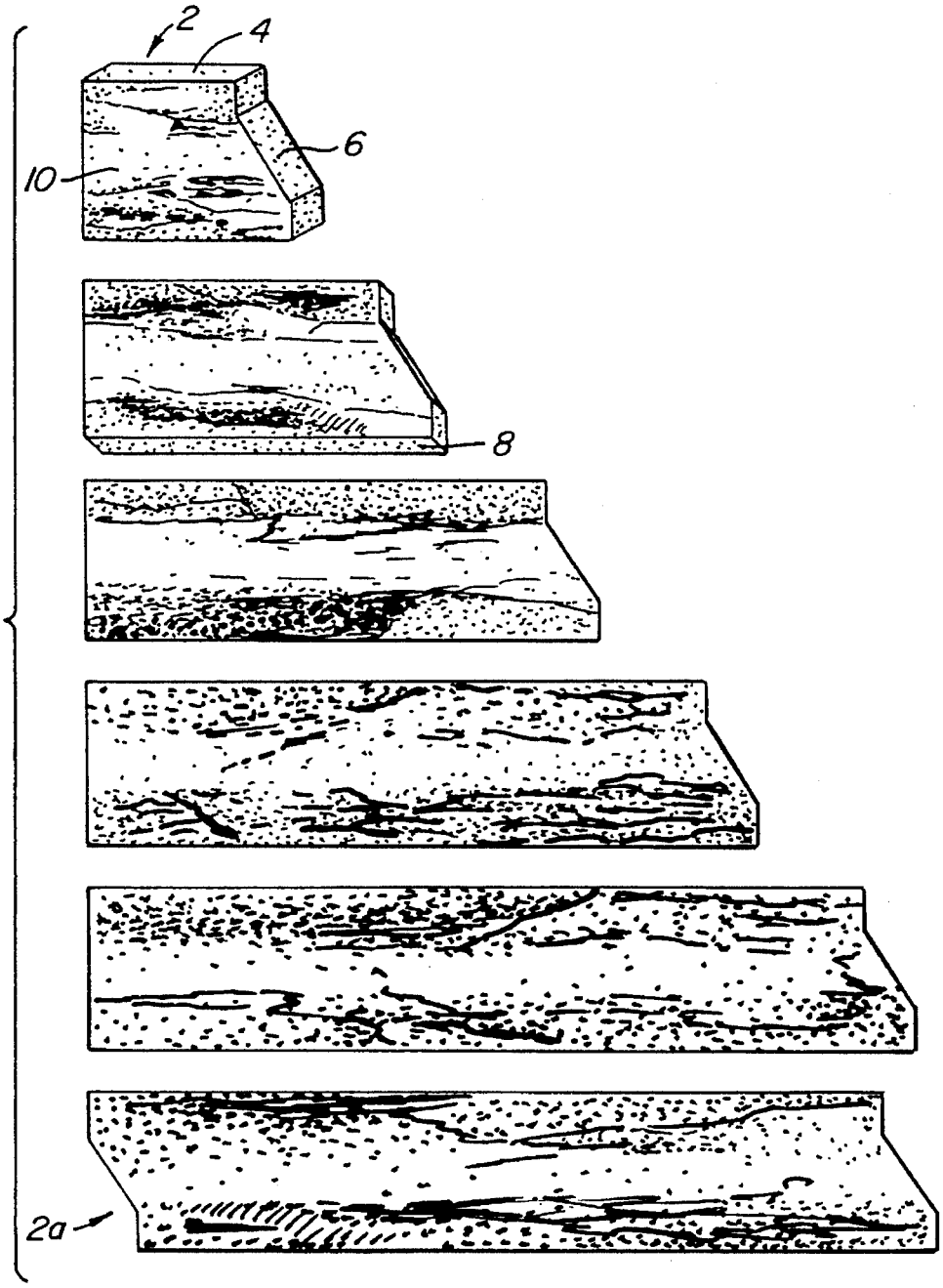
FIG. 1 shows side plan views including preferred dimensions of sections constructed in accordance with the invention.

Referring to the figures, FIG. 1 shows a section member 2 of the present invention which is in the preferred substantially quadrilateral configuration. The term "quadrilateral" is meant to include sections having an irregular lateral surface as depicted in FIG. 1. Section 2 has at least five surfaces including an upper surface 4, a lower surface 8, a lateral surface 6, a face surface 10 and a back surface 12. Upper and lower surfaces 4/8 are essentially parallel. In a preferred embodiment, section 2 has two lateral surfaces 6. Back surface 12 is substantially flat, as this is the portion of the section which will contact the adhesive on the structure to which the sections are to be mounted. Alternatively, back surface 12 can have a grooved surface to assist in providing an improved bonding surface between the mortar, grout or adhesive and the surface area to which it is adhered.

Figure 2:
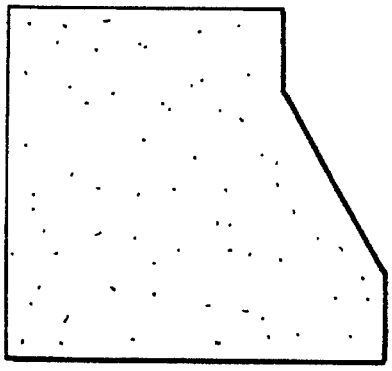
FIG. 2 is a plan view closeup of the circled portion of FIG. 1 showing the preferred lateral surface configuration.

The lateral surface may have any of a number of configurations. It may be in a plane perpendicular to the upper and lower surfaces, or it may take an angled or irregular configuration. In an embodiment resembling ledgestone, each section member has at least one lateral surface 6 which is irregular or angled. In the ledgestone embodiment, the lateral surface 6 preferably has dimensions as specified in FIG. 2. That is, about a one inch long region of lateral surface 6 adjoining each of upper surface 4 and lower surface 8 is substantially perpendicular to surfaces 4 and 8, respectively. An intermediate region of lateral surface 6 is angled about 30° with respect to surfaces 4/8.

When multiple sections are joined together with sections having cooperating and co-adapting lateral surfaces 6, the result provides a finished facade more closely resembling natural ledgestone or other stone texture because the joints are not all at precise right angles. Most preferably, the sections possess two lateral sides 6 having the irregular 30° angled configuration. See the section labeled 2*a* in FIG. 1.

The dimensions of the sections may vary considerably, but most preferably the sections have a height of about four inches. The height is the distance measured from the plane of the upper surface 4 to the lower surface 8. The thickness of the section, measured from the back surface to the front surface, may vary because the shape of the face surface 10 varies considerably to mimic natural stone. Typically, the thickness ranges from about one inch to about three and one-half or four inches. The length of the stone as measured from lateral surface to lateral surface varies from about four inches to about 20 inches.

Figure 6:
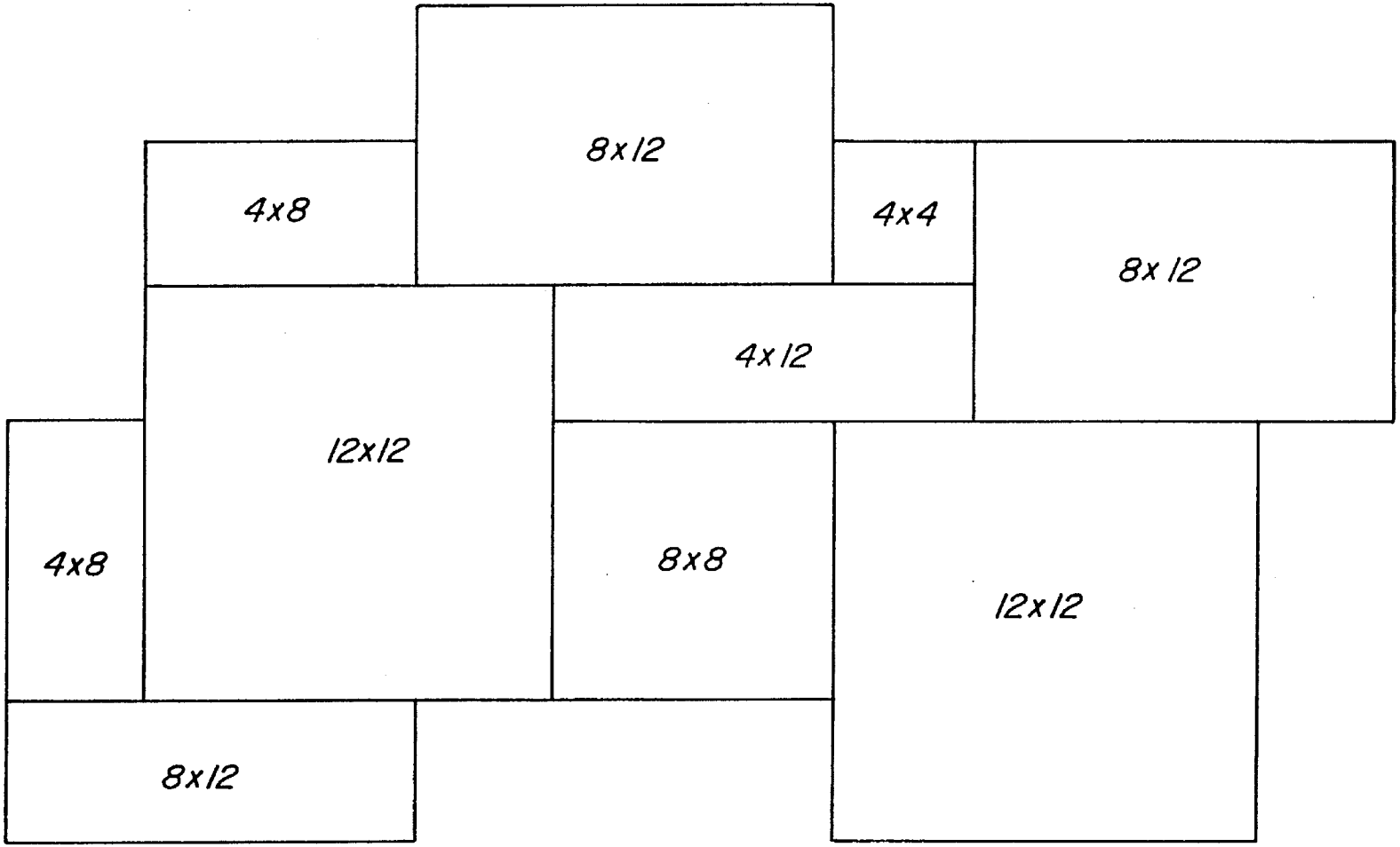
FIG. 6 shows additional component pieces which fit together in a repeating interlocking modular, ashlar pattern.

Alternatively, the sections can have lateral surfaces substantially perpendicular to the upper and lower surfaces. This ashlar embodiment is shown schematically in FIG. 6. The sections can be made in any of a number of dimensions. Preferably the dimensions of height and length are selected from an array including 4×4, 4×8, 4×12, 8×8, 8×12, and 12×12 inches. The thickness or depth is preferably from about 1 to about 4 inches. A thickness of about 1 to 2 inches is more preferred.

Longitudinal grooves 14 are provided in each of the upper surface 4 and lower surface 8. In a preferred embodiment, these grooves are about one-quarter inch wide and about one-quarter inch deep. The longitudinal orientation means that the grooves extend along the length of the sections in a plane substantially parallel to the back surface of the section. The grooves may be formed by casting in a mold, or alternatively they may be formed by cutting or drilling. Such cutting or drilling is preferably accomplished while the concrete is green or not yet completely cured.

Figure 3:
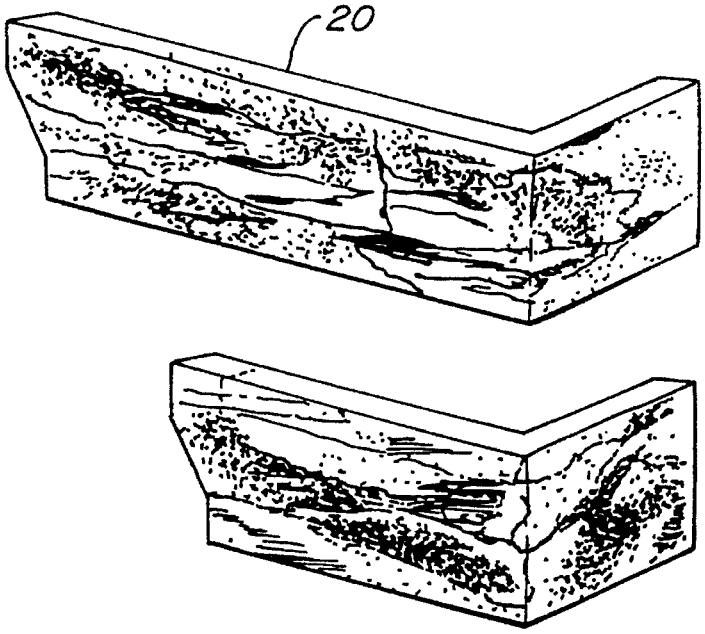
FIG. 3 shows corner sections constructed in accordance with the invention.
Figure 4:
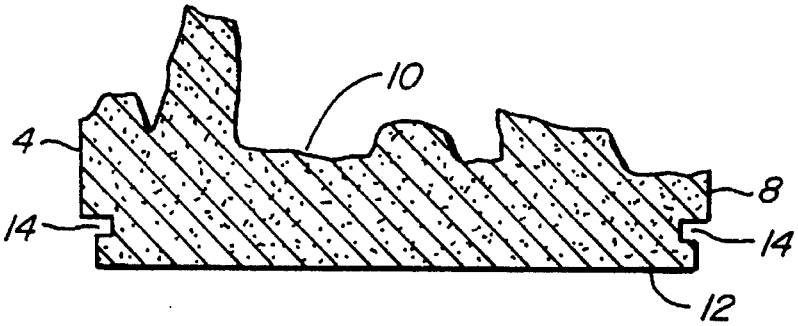
FIG. 4 is a cross-sectional view of a section indicating a preferred dimension and location of the groove as well as an impression of the irregular front face.

Corner sections may be formed in accordance with the present invention. See FIG. 3. The corner sections have a face surface texture similar to the sections as previously described below. The L-shaped configuration of the corner sections further enhances the natural appearance of the finished facade because a conventional grouted corner joint is avoided. Instead, the corner appears more like natural stone.

The front or face surface 10 of section 2 is cast to resemble natural stone such as ledgestone. Alternatively, a surface resembling a rock face or quarry face is used. That is, the section is formed, shaped, molded or casted to have a face surface texture including projections, depressions, crevices, cracks and a rough weathered look to mimic the appearance of natural stone.

Each section of the invention is individually installed. The sections are permanently attached to the wall surface to which they are applied. At about 8 to 10 pounds per square foot, the sections are relatively lightweight compared to natural stone. These features allow multi-story use where natural stone might be economically or structurally impossible to use.

Because the method of adhesive is accomplished by adhering instead of stacking or mechanical fastening, installation is fast and easy without requiring footings or wall ties. On clean, untreated masonry, brick or concrete, the sections are directly applied to the wall surface using a mortar or adhesive. On other surfaces, such as wood, wallboard and sheetrock, an expanded metal lath or other suitable mesh is first applied. A weather-resistant barrier such as waterproof building paper is typically used on all applications other than to masonry or concrete surfaces.

Figure 5A:
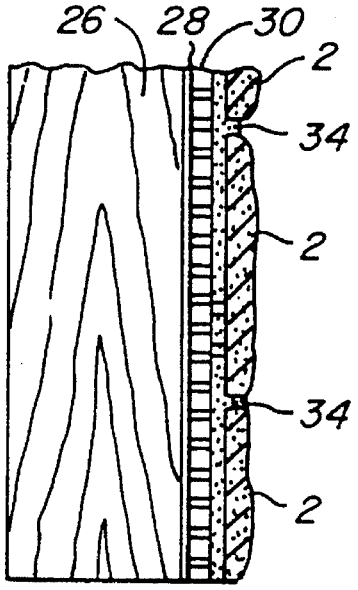
FIGS. 5A, B and C show cross sections of the invention when installed on structures of wood frame, concrete section and metal respectively.

Preferably, the corner pieces 20 are installed first. Installation of other sections may be started at either the top or bottom. When applying the sections to a wood frame or to open studs 26, a weather-resistant barrier 28 is first applied to the frame or studs. See FIG. 5A. Next, metal lath 30 is applied over the weather-resistant barrier 28. If open studs 26 are being used, a scratch coat 32 is next applied. A scratch coat refers to a rough-textured cementitous layer to which an adhesive or mortar is applied. Usually the scratch coat is comprised of Portland Cement and/or lime mortar. An application coat of adhesive (not shown) is applied and to this adhesive coating the sections are applied.

The sections are fitted closely together resulting in a minimal mortar joint 34. Compression of the section 2 against the coating of mortar or adhesive usually causes some flow of the semi-fluid mortar or adhesive onto the section. This flow is accepted by grooves 14, thus permitting close approximation of the sections upper and lower surfaces 4/8 without a visibly obvious grout joint. Additionally, the adhesive lodged in grooves 14 acts as a key or further bonding means between adjacent sections. Adhesive in groove 14 of upper surface 4 of a first section 2 contacts adhesive in groove 14 in lower surface 8 of a second section 2 where the second section is installed above the first section.

Figure 5B:
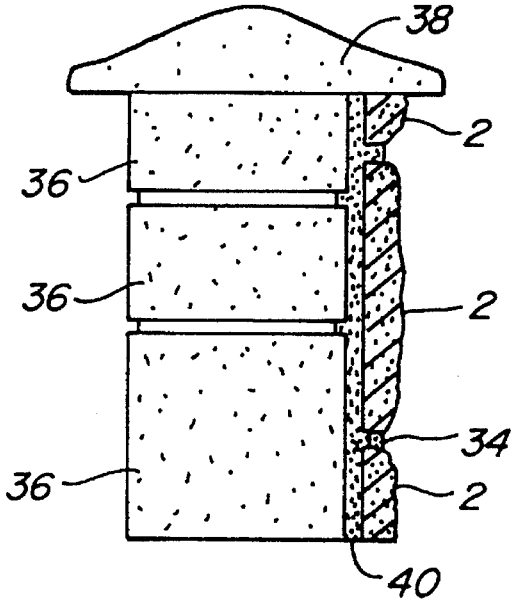

When applying the sections of the invention to a concrete block 36 or other masonry material, a masonry or concrete cap 38 is recommended. See FIG. 5B. Mortar 40 is applied directly to the masonry support surface 36 except when that surface is treated or painted. If treated or painted, application of a metal lath or sand blasting is recommended prior to application of mortar. The sections 2 are applied to the mortar coating.

Figure 5C:
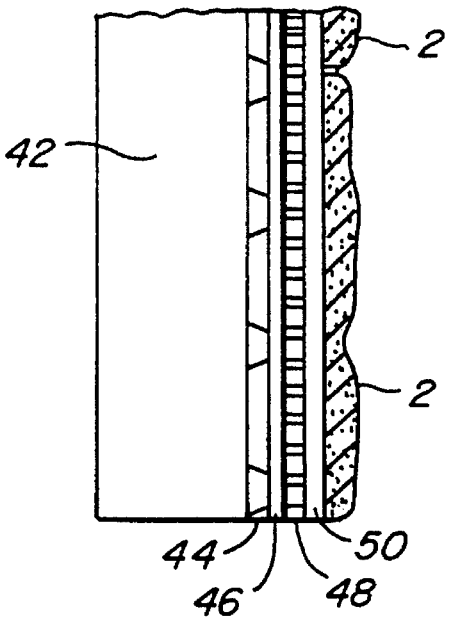

When applying the sections of the invention to a metal building or structural frame 42, a horizontal fastening girth 44 is first applied to the structural frame 42. See FIG. 5C. Next, a metal panel 46 is applied and then metal lath 48 with weather-resistant barrier is affixed to the metal panel 46. A scratch coat 50 is next applied, followed by an application coat of the adhesive or mortar (not shown). The sections 2 are applied to the adhesive coat as previously described.

A material preferred for forming the sections is concrete such as a mixture of Portland cement, lightweight aggregates, and iron oxide colors. The sections are preferably engineered to meet or exceed specifications set by building code officials. For example, the sections preferably conform to or exceed test requirements as specified in the International Conference of Building Officials Evaluation Service, Inc., Acceptance Criteria for Precast Stone Veneer. Some of the tests include shear bond test (adhesion), water absorption, freeze/thaw characteristics, compressive strength, unit weight, tensile strength, flexural strength, and transverse load strength. Additional tests include efflorescence tests, thermal properties, non-combustibility, and color fastness.

The artisan will appreciate that modifications or variations of the above-described embodiment are evident. For example, the dimensions of the sections and the angles of the side or lateral surfaces could be varied. Additionally, the use of material other than concrete may be practical or desirable. For instance, a clay or ceramic section could be employed. Also, the face surface of the section could be made to resemble something other than the preferred ledgestone, ashlar and rock face. For example, the facing could be formed to resemble sandstone or limestone having fossilized deposits or depressions therein. Thus, the invention is not limited by the above description of a preferred embodiment, but rather by the claims which follow.

What is claimed is:

1. A wall structure comprising:

a support; and first and second section members each having at least five surfaces, including an upper surface, a lower surface, a lateral surface, a face surface, side edges, and a back surface, wherein the back surface is substantially flat, the section members are bonded to the support by an adhesive applied to at least one of the support and the back surfaces of the section members, and the upper and lower surfaces of each section member have a groove formed therein, said groove being oriented in a longitudinal direction substantially in a plane parallel to the back surface, said section members being arranged against the support such that the upper surface of the first section member faces the lower surface of the second section member.

2. The wall structure of claim 1 wherein the adhesive is selected from a group comprising mastic, adhesive, epoxy, mortar, concrete, and grout.

3. The wall structure of claim 1 wherein an edge is formed at an intersection of two surfaces, the grooves being about equidistant from the edge.

4. The wall structure of claim 1 wherein the section members are formed of concrete.

5. The wall structure of claim 1 wherein the support is formed of a material selected from the group comprising metal, plywood, drywall masonry and concrete.

6. The wall structure of claim 1 wherein the section members are formed in a substantially quadrilateral shape.

7. The wall structure of claim 1 wherein the upper and lower surfaces are substantially parallel and the lateral surfaces are substantially perpendicular to the upper and lower surfaces.

8. The wall structure of claim 1 wherein the face surfaces are shaped to resemble either natural unchiseled stone or quarried stone.

9. The wall structure of claim 1 wherein the grooves are at least partially filled with the adhesive thereby forming a bond between the sections members.

10. A method of installation of a wall structure having a section member with an outer surface and a groove formed thereon, said groove being adapted to accept an adhesive comprising the steps of:

a. applying adhesive for holding the section member to a support; and b. contacting the section member to the support thereby permitting the adhesive to bond the section member to the support; and c. allowing the adhesive to flow into the groove.

11. The wall structure of claim 10 wherein the section member is molded in a form to have a face surface texture resembling that of natural stone.

12. The wall structure of claim 10 wherein the groove is formed by casting, cutting or drilling.

13. The wall structure of claim 12 wherein the cutting or drilling is performed while the concrete is green.

* * * * *